US009205453B2

(12) United States Patent
Smit et al.

(10) Patent No.: US 9,205,453 B2
(45) Date of Patent: Dec. 8, 2015

(54) METHOD AND APPARATUS FOR THE PRODUCTION OF FINE FIBRES

(71) Applicant: Stellenbosch University, Stellenbosch (ZA)

(72) Inventors: Anton Eugene Smit, Boksburg (ZA); Ronald Douglas Sanderson, Stellenbosch (ZA)

(73) Assignee: Stellenbosch University, Stellenbosch, Western Case Province (ZA)

( * ) Notice: Subject to any disclaimer, the term of this patent is extended or adjusted under 35 U.S.C. 154(b) by 0 days.

(21) Appl. No.: 14/301,528

(22) Filed: Jun. 11, 2014

(65) Prior Publication Data

US 2014/0302245 A1 Oct. 9, 2014

Related U.S. Application Data

(62) Division of application No. 13/000,468, filed as application No. PCT/IB2009/006025 on Jun. 23, 2009, now Pat. No. 8,778,254.

(30) Foreign Application Priority Data

Jun. 24, 2008 (ZA) ..... 2008/05533

(51) Int. Cl.
*D01D 5/16* (2006.01)
*B05D 1/00* (2006.01)
*D01D 5/00* (2006.01)

(52) U.S. Cl.
CPC ..... *B05D 1/007* (2013.01); *D01D 5/003* (2013.01); *D01D 5/0069* (2013.01)

(58) Field of Classification Search
USPC ..... 425/174.8 E
See application file for complete search history.

(56) References Cited

U.S. PATENT DOCUMENTS

| | | | |
|---|---|---|---|
| 3,994,258 | A | 11/1976 | Simm |
| 4,143,196 | A | 3/1979 | Simm et al. |
| 7,600,990 | B2 | 10/2009 | Chang et al. |

FOREIGN PATENT DOCUMENTS

| | | | |
|---|---|---|---|
| EP | 1409775 | B1 | 12/2004 |
| WO | WO-2007/054039 | A1 | 5/2007 |
| WO | WO-2007/137530 | A2 | 12/2007 |

OTHER PUBLICATIONS

Extended European Search Report from European Patent Application No. 09769635.5, dated Dec. 7, 2011 (date of completion of search) and Dec. 14, 2011 (date of mailing of report).
International Search Report from PCT/IB2009/006025 dated Oct. 13, 2009 (date of completion of search) and Oct. 27, 2009 (date of mailing of report).

*Primary Examiner* — Christina Johnson
*Assistant Examiner* — Xue Liu
(74) *Attorney, Agent, or Firm* — Clark & Elbing LLP; Susan M. Michaud

(57) ABSTRACT

A method and apparatus provided for the production of fine fibers by electrospinning fibers by applying an electrical field between a primary electrode and a counter electrode (5) spaced apart from the primary electrode and extending generally parallel thereto wherein at least an operative surface of the primary electrode is coated with a polymer solution (3) and an electric field of sufficient magnitude is generated between the primary electrode and counter electrode to cause the formation of fine fibers (9) in the space between the electrodes. The operative surface of the primary electrode that is coated with polymer solution is made up of appropriate portions of the surfaces of a multitude of operatively semi-submerged, loose (unattached) elements (1, 11, 17, 21) supported on the bottom of a trough (2) or tray or another support member or members (12, 18, 22). Facility is included for causing polymer solution to be applied to the exposed surfaces of the loose elements by causing them to roll in the polymer solution so that they become coated with a thin layer of polymer solution on their surfaces.

6 Claims, 3 Drawing Sheets

METHOD AND APPARATUS FOR THE PRODUCTION OF FINE FIBRES

CROSS-REFERENCE TO RELATED APPLICATIONS

This application is a divisional of U.S. patent application Ser. No. 13/000,468, filed Feb. 8, 2011, which is the U.S. national stage filing under 35 U.S.C. §371 of international patent application PCT/IB2009/006025, filed Jun. 23, 2009, which claims benefit of South Africa Patent Application 2008/05533, filed Jun. 24, 2008.

FIELD OF THE INVENTION

This invention relates a method and apparatus for the production of fine fibres, particularly, but not exclusively, very fine fibres of the general nature often referred to as nanofibres, from various polymers, polymer blends, ceramic precursor mixtures and metal precursor mixtures.

BACKGROUND TO THE INVENTION

Very fine fibres produced from polymer solutions, often referred to as nanofibres, are useful in a wide variety of applications, including filter media, tissue-engineering scaffold structures and devices, nanofibre-reinforced composite materials, sensors, electrodes for batteries and fuel cells, catalyst support materials, wiping cloths, absorbent pads, post-operative adhesion preventative agents, smart-textiles as well as in artificial cashmere and artificial leather.

Electrostatic spinning of fibres was, it appears, first described in U.S. Pat. No. 692,631. In principle, a droplet of polymer solution or melt is placed in a strong electric field giving rise to the repulsion between the induced like-charges in the droplet competing with the surface tension of the liquid. When a sufficiently strong electric field is applied (typically 0.5-4 kV/cm), the electrostatic forces can overcome the surface tension of the fluid and a jet of polymer solution or melt is ejected from the droplet.

Electrostatic instability leads to rapid, chaotic whipping of the jet, leading, in turn, to fast evaporation of any solvent as well as a stretching and thinning of the polymer fibre that is left behind. The formed fibres are then collected on a counter electrode, typically in the form of a nonwoven web. The collected fibres are usually quite uniform and can have fibre diameters of several micrometers, down to as low as 5 nm.

The technical barriers to manufacturing large quantities of nanofibres by electrospinning include low production rates and the fact that most polymers are spun from solution.

One general method of production utilises multiple passages such as may be provided by multiple needles. On average, solution based electrospinning, using needle spinnerets, have solution throughput rates on the order of 1 ml per hour per needle. Fibres with diameters in the range of 50 to 100 nm are typically spun from solutions with relatively low concentrations, typically 5-10 wt % depending on polymer type and molecular weight. This means that, assuming a polymer density of around 1 g/ml, the typical solids throughput rate of a needle-based electrospinning process is 0.05 g to 0.1 g of fibre per hour per needle. At this rate, production of a nanofibre web with a planar density of 80 g/m$^2$ at a rate of 5 m$^2$/s will require a minimum of 14,400,000 needles.

In addition, electrical field interference between the different needles limits the minimum separation between them and furthermore, continuous operation of needle-based spinnerets requires frequent cleaning of the needles as polymer deposits tend to block the spinnerets. The overall result is that the production of industrial volumes becomes almost prohibitively expensive for most commodity applications like filtration and absorbent textiles.

Formhals (U.S. Pat. No. 1,975,504) tried to increase electrospinning production rates by using a serrated wheel as the one electrode. In later designs, he used a multiple needle setup (U.S. Pat. No. 2,109,333).

Reneker et al. (international patent application publication number WO0022207) describe a process in which nanofibres are produced by feeding fibre-forming solution into an annular column, forcing a gas through the column in order to form an annular film, which is then broken up into numerous strands of fibre-forming material.

Numerous other proposals have been put forward that rely on creating jets of fibre-forming solution using needles and orifices in order to produce fibres in this manner.

A system with a significantly high throughput, known as NanoSpider, is described in international patent application publication number WO05024101. In this system the fibre forming polymer solution is contained in a dish and a partly exposed conductive cylinder is slowly rotated in it to form a thin layer of solution on its surface. A counter-electrode is placed 10-20 cm above the cylinder and hundreds of jets initiate off the surface of the cylinder and electrospin onto the target.

International patent application publication number WO 2006131081 describes a follow up type of NanoSpider technology in which the conductive cylinders are replaced by axially mounted rotatable cylindrical structures presenting multiple "discharge" surfaces from which solution is to be discharged to form the polymer fibres. The arrangement is somewhat complex and the cylindrical structures must be somewhat costly.

Japanese patent JP3918179 describes a process in which bubbles are continuously generated on the surface of a polymer solution by blowing compressed air into the solution through a porous membrane, or through a thin tube. Electrospinning jets are formed on the bubbles and fibres that form are collected on the counter-electrode. This system, it appears to applicant, requires that the bubbles in the polymer solution be formed in high volumes and that they burst very rapidly. Also, most organic solvents do not readily form foams and the given examples demonstrate spinning only with polymer solutions in water, 2-propanol and acetone. Additionally, this patent requires that the counter-electrode be placed at a suitable distance from the foam since droplets of spin solution that are created by the constantly bursting bubbles can spatter onto and harm or destroy the formed fibres on the counter-electrode.

In our pending international patent application published under number WO 2008125971 we describe an improvement of the bubble electrospinning process, based on the stabilization of the formed bubbles using a surfactant.

OBJECT OF THE INVENTION

It is an object of this invention to provide a method and apparatus for producing such fibres, which overcomes, at least to some extent, one or more of the abovementioned problems relating to high throughput production of electrostatically spun fibres.

SUMMARY OF THE INVENTION

In accordance with one aspect of this invention there is provided a method for the production of fine fibres by electrospinning fibres by applying an electrical field between a primary electrode and a counter electrode spaced apart from the primary electrode and extending generally parallel thereto wherein at least an operative surface of the primary electrode is coated with a polymer solution and an electric field of sufficient magnitude is generated between the primary electrode and counter electrode to cause the formation of fine fibres in the space between the electrodes, the method being characterised in that the operative surface of the primary electrode that is coated with polymer solution is made up of appropriate portions of the surfaces of a multitude of operatively semi-submerged, loose (unattached) elements supported on the bottom of a trough or tray or another support member or members and wherein facility is included for causing polymer solution to be applied to the exposed surfaces of the loose elements by causing them to roll in the polymer solution so that they become coated with a thin layer of polymer solution on their surfaces.

The elements are typically rounded and most commonly circular when viewed in at least one direction. They can be spheres, cylinders or intermediate ellipsoidal shapes, although the preferred shape is presently spherical.

Rolling can be promoted by tilting the tray or trough or a support member in it.

Alternatively, a support plate or the like could be moved relative to the elements to cause them to rotate with such movement typically, in this variation, being a reciprocal to and fro movement or a circular motion.

In another variation, the elements may be moved around using rods or frames. For example, a surrounding frame may be packed with elements to fill a certain area with the elements supported on a support member in the form of a moving surface such as a broad endless belt beneath the elements with the whole setup being semi-submerged in the polymer solution.

In the case of steel elements or elements made of other magnetic material they may be caused to roll under the influence of changing magnetic fields.

The surface of the elements will generally be smooth, but it can also be textured in various ways, such as through spiked protrusions; grooves in the surface; or any other form of texturing that distorts the smooth surface of the element.

The elements can have a size anywhere within in the range of from about 1 mm to about 300 mm, and generally between about 3 mm and about 30 mm. The elements can be made of steel, glass, or any other suitable material with the requirement that they should be suitably stable in the polymer solution and be tolerated by the relevant mechanisms of the apparatus.

The polymer solution can be a solution of any natural or synthetic polymer in a suitable solvent, or blends of different polymers, or a sol-gel mixture, or any other combination of components that would yield fibres when electrospun by an electrospinning process. The polymer solution can also contain additives that may be required to modify the surface tension, viscosity and/or other rheological or electrical properties of the solution.

In accordance with a second aspect of this invention there is provided apparatus for the production of fine fibres by a method as defined above wherein a primary electrode is located in spaced relationship relative to a counter electrode and generally parallel thereto, the apparatus being characterised in that the operative surface of the primary electrode that is to be coated with polymer solution in use, is made up of appropriate portions of the surfaces of a multitude of operatively semi-submerged, loose (unattached) elements supported on the bottom of a trough or tray or another support member or members and wherein facility is included for causing polymer solution to be applied to the exposed surfaces of the loose elements by causing them to roll in the polymer solution so that they become coated with a thin layer of polymer solution on their surfaces.

Further features of this aspect of the invention follow directly from the further features of the first aspect of the invention.

The process is also suitable for combination with specialized nanofibre collectors for manufacture of geometrically more complex nanofibre structures, such as the nanofibre yarn formation apparatus described in our pending international patent application published under number WO2008062264.

In order that the invention may be more fully understood some examples thereof will now be described with reference to the accompanying drawings.

DETAILED DESCRIPTION WITH REFERENCE TO THE DRAWINGS

Figure 1:
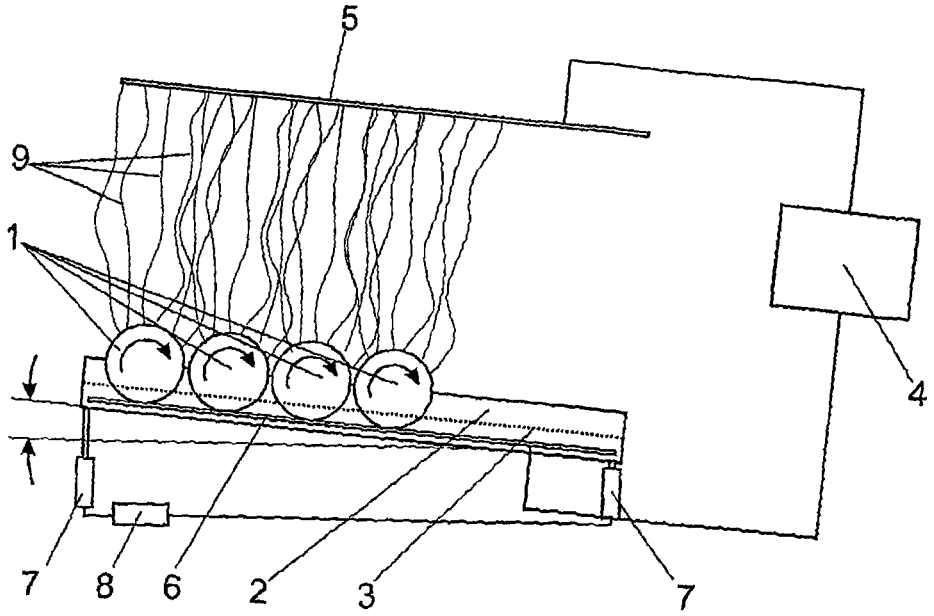
FIG. 1 is a schematic side illustration of one form of implementation of the invention.

In the embodiment of the invention illustrated in FIG. 1, multiple loose elements (1), more particularly spheres, are arranged to define what, in effect, is a primary electrode with the multiple loose spheres being arranged so that they can roll under the influence of gravity along a downward-sloping trough (2) containing polymer solution (3), when the trough is tilted adequately. Tilting of the trough is thus aimed at causing a thin layer of polymer solution to form on the exposed surfaces of the spheres which are only partly submerged in it.

A high voltage power supply (4) is applied between the primary electrode and a counter electrode (5) that is generally parallel to it but spaced apart from the primary electrode. Electrical contact with the polymer solution carried on the exposed surfaces of the spheres is maintained by way of a contact plate (6) on which the spheres are supported within the trough.

Repeated movements of the spheres is achieved by tilting the trough firstly in one direction and then in the opposite, or at least another direction, so that the spheres move sequentially, and typically to and fro within the trough, each time rotating and collecting a thin layer of polymer solution on their surfaces. Tilting of the trough may be achieved in any manner such as by extending and retracting supporting piston and cylinder assemblies (7) located at or towards the corners of the trough. Operation of such piston and cylinder assemblies may be either hydraulic or pneumatic and may be controlled automatically by means of a suitably timed automatic valve assembly (8), for example. Alternatively, the trough could be supported by way of suitable cams that, when rotated, cause sequential tilting in different directions.

The production of fibres is controlled, in particular by controlling the voltage applied between the primary and counter electrodes, such that multiple electrospinning jets (9) erupt from the surfaces of the spheres under influence of the high voltage that is applied. Other than the construction of the primary electrode, the apparatus operates along lines that are well-known to those skilled in the art and further detail of which need not be included herein.

It is, however, to be noted that sometimes it may be necessary to initiate jet formation on the spheres by physically contacting the wetted surface such as by tapping the wetted surface with a glass rod. The result is the formation of a sharp tipped liquid protrusion on the liquid surface as the glass rod moves away again, for example. One or more jets then erupt from that point. The high charge on the spheres then leads to automatic splitting of the first jet (or jets) into multiple jets, which spread to the other spheres without further intervention from outside. Such an initiation could also be performed in many other ways involving some physical deformation of the liquid layer on a sphere.

It will be appreciated that any suitable shape, or combination of shapes, which enables the elements to roll could be used instead of spheres. For example, the elements could be cylindrical in shape or even of ellipsoidal shape.

Figure 2:
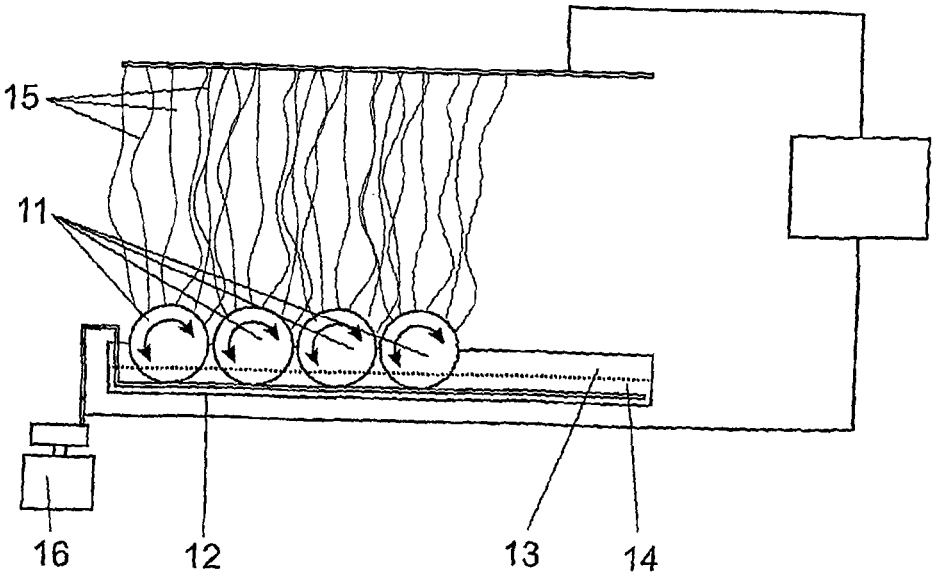
FIG. 2 is a schematic side illustration of a second form of implementation of the invention.

Referring now to FIG. 2 of the drawings, a similar form is illustrated in which similar spheres (11) are supported by a submerged horizontal support member (12) which is movable in a trough (13), in use, in a to and fro or circular motion to cause the spheres to roll around in the polymer solution (14) inside the trough. This movement is arranged to cause a thin layer of polymer solution to form on the exposed surfaces of the spheres as described above.

Multiple electrospinning jets (15) erupt, in use, from the sphere surfaces under the influence of the high voltage that is applied. Movement of the support member may be achieved using any suitable mechanism and an electrical motor driving an eccentric, as indicated by numeral (16) is considered to be one alternative.

Figure 3:
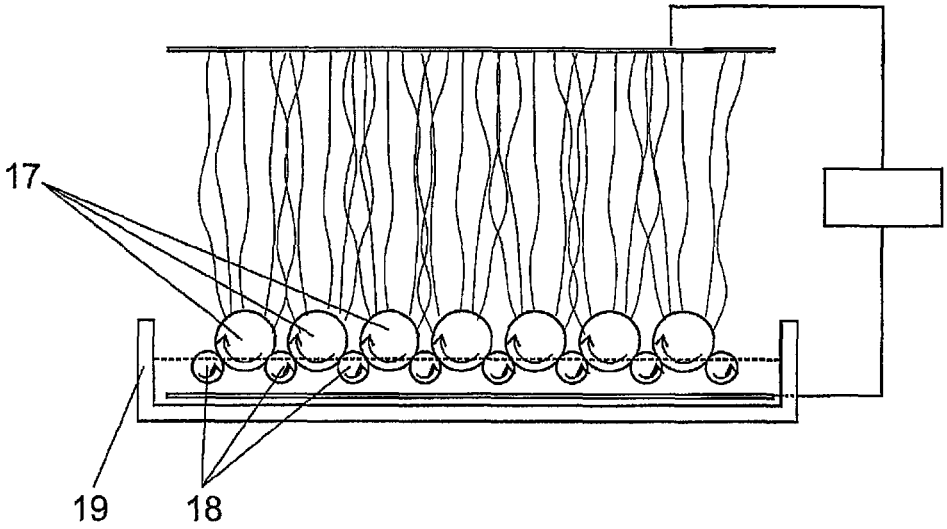
FIG. 3 is a schematic side illustration of a third form of implementation of the invention.
Figure 4:
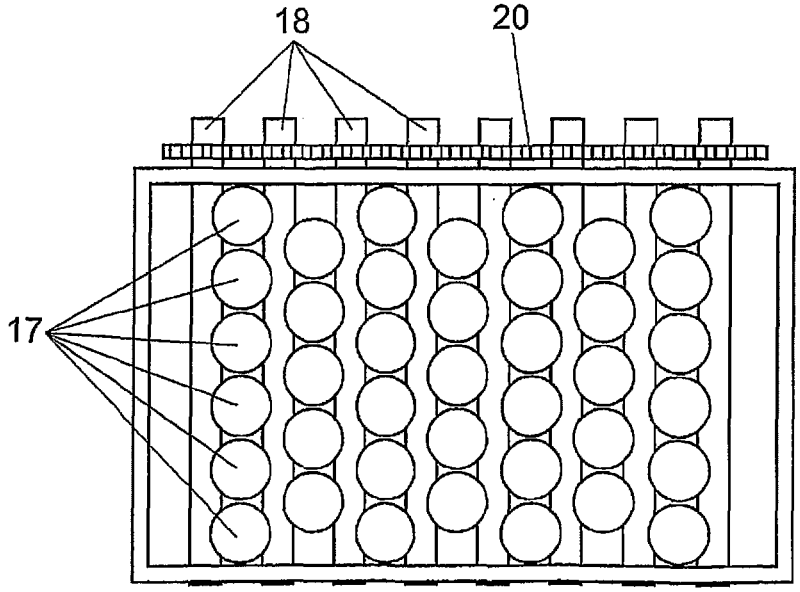
FIG. 4 is a schematic plan view of the third form of the invention illustrated in FIG. 3.

Referring to FIGS. 3 and 4, in a third form of the invention, spheres (17) are supported between adjacent parallel, rotating rods (18) and are partly submerged in a trough (19). The rods (18) are driven in unison by a sprocket and chain drive (20) and the spheres (17) are thereby caused to rotate. The parts of the spheres (17) extending between the rods (18) are immersed in the polymer solution and the surfaces of the spheres become coated with a thin layer of polymer solution as they are rotated. Depending on the size and spacing of the rods and spheres, the rods may be totally submerged or even slightly above the surface of the polymer solution with part of the spheres immersed in the solution.

Figure 5:
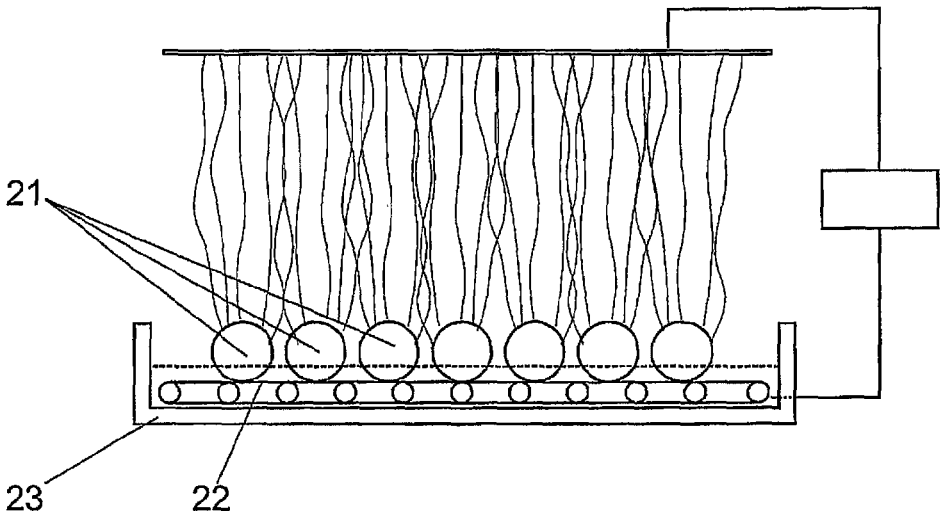
FIG. 5 is a schematic side illustration of a fourth form of the implementation of the invention and, FIGS. 6 and 7 illustrate alternative shapes of elements.

In the instance of the embodiment of the invention illustrated in FIG. 5, spheres (21) are supported on a broad endless belt (22) located within a trough (23) such that when the belt is driven, the spheres will rotate with the result described above.

The method and apparatus of the invention allows for high throughput spinning without the difficulties associates with the use of needles. This is achieved by creating what can possibly be described as a solid, bubble-like surface. The coated elements simulate bubbles on the surface of a polymer spinning solution but have the advantage that they do not burst, causing destructive splatter, and maintain a constant geometry leading to better process control, predictability and uniformity.

Figure 6:
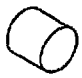
Figure 7:
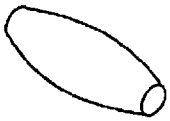

By using multiple loose (unattached) rolling elements, this invention overcomes the limitations imposed by the Nano-Spider's pivoted cylinder design. The application of multiple loose (i.e. un-pivoted) rolling elements simultaneously allows for the concurrent use of different-sized rolling elements, more optimal utilisation of spin equipment area through denser packing of rolling elements, and also gives an additional degree of freedom in the rolling element's manoeuvrability and conversely more freedom in the design possibilities for the equipment It will be understood that numerous different arrangements are possible within the scope of this invention without departing from the scope hereof. In particular, numerous variations are possible to the shape and configuration of the elements and the manner in which they are supported. Thus, for example, they may be basically cylindrical, as illustrated in FIG. 6, although maybe ellipsoidal, as illustrated in FIG. 7. If desired, the elements could also have textured surfaces which may include a multiplicity of small projections.

The invention claimed is:

1. Apparatus for the production of fibres comprising a primary electrode and a counter electrode wherein the primary electrode is located in spaced relationship relative to the counter electrode and generally parallel thereto thereby defining a space between the electrodes and wherein at least an operative surface of the primary electrode is coated with a polymer solution, and a facility for generating an electric field of sufficient magnitude between the primary electrode and the counter electrode to cause the formation of fibres in the space between the electrodes, and wherein the operative surface of the primary electrode that is to be coated with polymer solution in use, is made up of an exposed unsubmerged surface of a multitude of operatively semi-submerged, loose elements supported on a trough or tray or another support member or members and wherein facility is included for causing polymer solution to be applied to the exposed unsubmerged surfaces of the loose elements by causing the elements to roll in the polymer solution so that the exposed unsubmerged surfaces of the elements become coated with a layer of polymer solution.

2. Apparatus as claimed in claim 1 in which the elements are circular when viewed in at least one direction and are selected from spheres, cylinders and ellipsoidal shapes.

3. Apparatus as claimed in claim 1 in which the facility included for causing polymer solution to be applied to the exposed surfaces of the loose elements by causing the elements to roll in the polymer solution includes means for tilting the tray, trough or other support member to cause the elements to roll in the polymer solution.

4. Apparatus as claimed in claim 1 in which the facility included for causing polymer solution to be applied to the exposed surfaces of the loose elements by causing the elements to roll in the polymer solution includes rods, frames or an abroad endless belt beneath the elements movable, in each instance, to cause rolling of the elements that are semi-submerged in polymer solution.

5. Apparatus as claimed in claim 2 in which the facility included for causing polymer solution to be applied to the exposed surfaces of the loose elements by causing the elements to roll in the polymer solution includes means for tilting the tray, trough or other support member to cause the elements to roll in the polymer solution.

6. Apparatus as claimed in claim 2 in which the facility included for causing polymer solution to be applied to the exposed surfaces of the loose elements by causing the elements to roll in the polymer solution includes rods, frames or an endless belt beneath the elements moveable, in each instance, to cause rolling of the elements that are semi-submerged in polymer solution.

* * * * *

UNITED STATES PATENT AND TRADEMARK OFFICE

CERTIFICATE OF CORRECTION

PATENT NO. : 9,205,453 B2
APPLICATION NO. : 14/301528
DATED : December 8, 2015
INVENTOR(S) : Anton Eugene Smit et al.

It is certified that error appears in the above-identified patent and that said Letters Patent is hereby corrected as shown below:

In the claims,

Column 6, Lines 58-59, replace “frames or an abroad endless belt” with --frames or an endless belt--.

Signed and Sealed this
Twenty-ninth Day of March, 2016

Michelle K. Lee

Michelle K. Lee
*Director of the United States Patent and Trademark Office*